United States Patent [19]

Wolcott

[11] Patent Number: 4,644,599

[45] Date of Patent: Feb. 24, 1987

[54] BED COVER LIFTER

[76] Inventor: Anna M. Wolcott, 13122 Bow Pl., Santa Ana, Calif. 92705

[21] Appl. No.: 650,215

[22] Filed: Sep. 13, 1984

[51] Int. Cl.[4] ..... A47C 21/02

[52] U.S. Cl. ..... 5/504; 5/505; 5/414

[58] Field of Search ..... 5/414, 504–506

[56] References Cited

U.S. PATENT DOCUMENTS

| | | | |
|---|---|---|---|
| 800,779 | 10/1905 | Woodward | 5/505 |
| 802,610 | 10/1905 | Tuttle | 5/505 |
| 1,351,557 | 8/1920 | Dobbins | 5/505 |
| 2,112,122 | 3/1938 | Sullivan | 5/505 |
| 2,210,255 | 8/1940 | Peevey | 5/505 |
| 2,598,295 | 5/1952 | Pelton | 5/505 |
| 2,614,269 | 10/1952 | Hougham | 5/505 |
| 4,043,349 | 8/1977 | Gays et al. | 5/414 |
| 4,152,792 | 5/1979 | Glintz | 5/414 |

FOREIGN PATENT DOCUMENTS

| | | | |
|---|---|---|---|
| 511321 | 3/1955 | Canada | 5/505 |

*Primary Examiner*—Kenneth J. Dorner
*Assistant Examiner*—Michael F. Trettel
*Attorney, Agent, or Firm*—Edward E. Roberts

[57] ABSTRACT

A device for keeping bedclothes off the bodies of patients, particularly burn victims and those who are bothered by the weight of bedclothes, comprising six multisectional arms composed of removable, extendable sections that may accomodate all widths. Two horizontal arms each moveably attached to two vertical arms and fastening to one of two gears of an electric motor mounted under the bed. The two foot arms are attached to the removable second gear.

By use of the electric motor and the removal of various of the vertical arms any combination of areas of the top covers may be kept from the patient's body.

2 Claims, 5 Drawing Figures

BED COVER LIFTER

BACKGROUND OF THE INVENTION

1. Field of the Invention

This invention relates to automatic bed cover lifters in general and particularly to those devices that are adjustable, that is, the fact that covers may be elevated while the upper torso has full contact with the covers.

2. Description of the Prior Art

It is well known that many invalids have great difficulty with the weight of ordinary bedclothes. Particularly burn victims have such problems. The pressure of even light sheets or blankets upon the burned surfaces of the body often become unbearable. In addition, there are numerous diseases that increase the sensitivity of the skin to the pressure imposed by the weight of the usual bedding materials used in the United States.

There are also individuals who suffer from lack of sleep at night because they are more sensitive to the pressure imposed by the weight of the bedding on the body.

We have searched through the prior art and have found no one who has perfected such a device. While there is a foot bed clothing lifter, no single device combines all the features found in this device.

SUMMARY OF THE INVENTION

This is an invention that enables one to raise his top bedclothes at will so that if desired the individual can be completely free from the pressure of bedding upon his body. Or, if desired, he can raise the foot bedclothing only and have his upper torso completely in contact with the top covers. Or, he can raise the upper torso covers only and have his feet completely covered. Thus, regardless of the injury he has suffered or the disease with which he is afflicted the individual will have complete relief from the pressure of offending bedclothes. In most cases he will quickly assume a realized state and fall asleep. His sleep will be restful and relaxed due to the lack of pressure of upper sheets and blankets upon his body.

An object of this invention is to provide a simple highly efficient device for lifting the top covers of a conventional hospital bed and to support either the upper or lower torso or both, top bedding out of direct contact with the user's body. This will result in the user achieving complete freedom, if desired, from the pressure of the bedcovers or the weight thereof on his body.

A further object of this invention is to provide a device that can be used only when desired and easily lowered or raised at the user's command.

A still further object of this invention is to attach this device to a conventional hospital bed where any part or all of it may be easily lowered into an inoperative position concealed beneath the bedding so as not to detract from the appearance of the bed.

Still a further object of this invention is the adjustable width feature which enables the device to be mounted on various width beds up to king size and still lift the bed covers as desired.

Another object of this invention is the easily removability and storage of the arch-shaped members when the device is not in use so that the bed may be readily and quickly made up by a relatively inexperienced person.

Other objects of this invention will appear from the following drawings, description and annexed claims. In the accompanying drawings is disclosed one mode designed to carry out the various objects of the invention but it is understood that the invention is not confined to the exact features shown, as various changes may be made by those skilled in the art and yet not depart from the spirit and scope of the claims which follow.

DESCRIPTION OF THE PREFERRED EMBODIMENT

Figures 1, 2, 3, 4, 5:
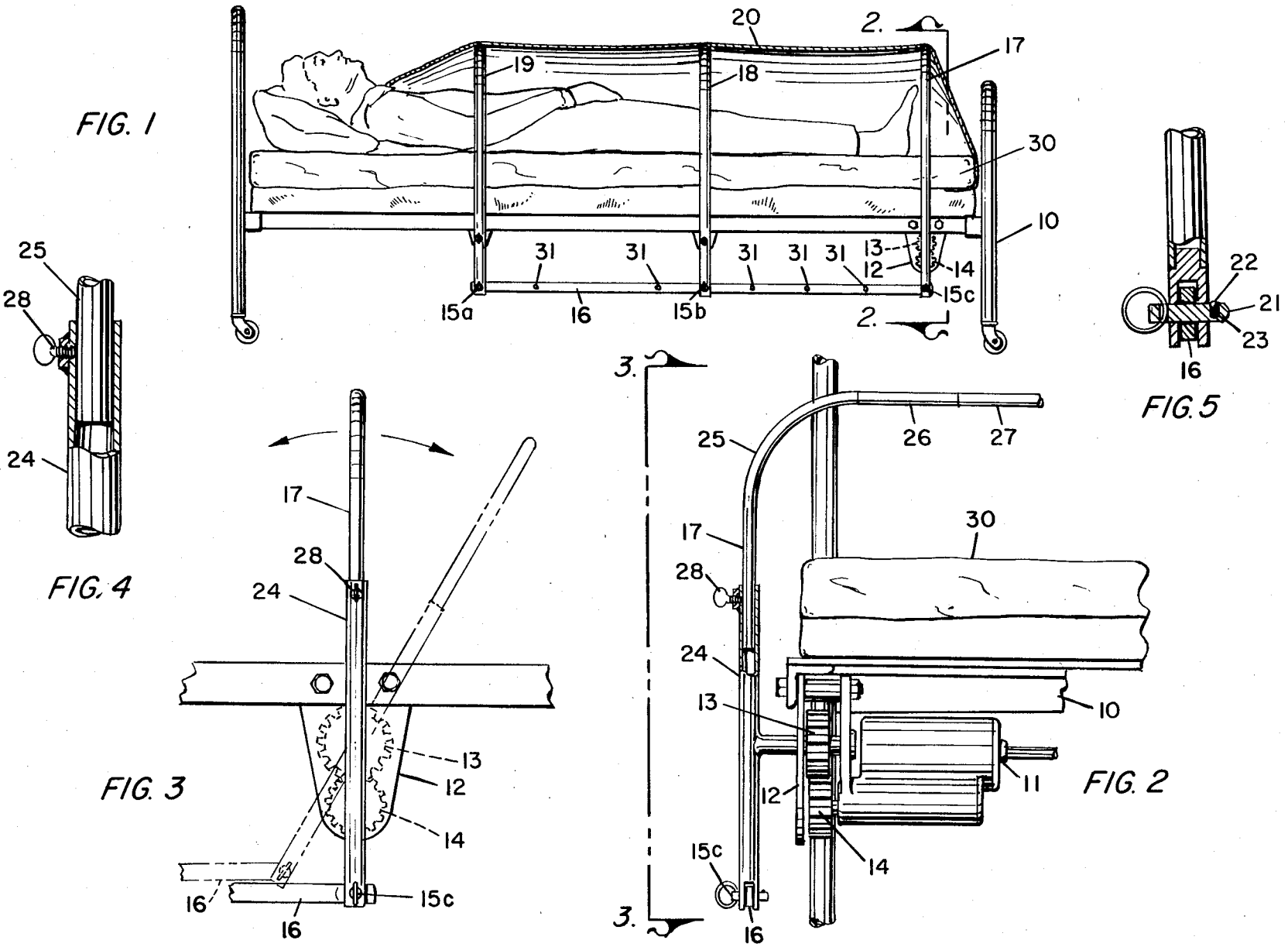
FIG. 1 is an illustrated side view of the invention on a normal hospital bed.
FIG. 2 is a view looking toward the head of a cut through 2—2 of FIG. 1.
FIG. 3 is a side view taken through 3—3 of FIG. 2.
FIG. 4 is a view of a telescoping extension joint used in the bedcover support.
FIG. 5 is a view of a detachable connection used at the lower ends of the bedcover supports.

The invention can best be seen in FIG. 1. There, a bed 10 has an electric motor 11 mounted beneath it. A triangular shaped metal bracket 12 holds motor 11 to the bed by means of two ordinary bolts (not numbered). The supports 17, 18, 19 for the bedclothing 20 are arranged in three equidistant spaces from top to bottom. A straight leg 16 joins all three supports 17, 18, 19 and lifts them to their operative mode. The supports 17, 18 and 19 are composed of four segments. A straight segment 24 extends from the lower end up to an area a little lower than the top of the mattress 30. It contains a friction applying thumb screw 28 and a disengaging pull ring 15. The pull ring 15 pulls finger 21 from an opening through which it locks support 17 attached to gear 13 into a position so that gear 13 meshes with gear 14. This causes the supports 18 and 19 to be lifted in unison with 17 lifting the bedcovers 20 so they are off the body in their entire length. By depressing ball 22 against spring 23 the finger 21 can be withdrawn bu pulling in ring 15. This allows one to disengage gear 13 from gear 14, lay down supports 18 and 19 and re-engage gear 13 in the upright position. In this mode, the covers are off the feet and on the torso. In like manner each ring **15*a*, 15*b* or 15*c* can be removed that support held upright and the rest lowered. The finger is reinserted into the appropriate hole 31 to lift the upper covers from the distressed area of the body. The support has a second section 25 that is curved 90° and slides into 24 and is secured by a friction fit. A third portion 26 fits into the end of curved section 25 and a fourth section 27 frictionally fits into 26 enabling one to use the device on any width bed. In use the top three sections 25,26 and 27 are lowered and removed then no impediment prevents the covers from being lowered. The bed then can be any width. The thumb screw 28 is used to hold sections 25, 26 and 27 at the right height above leg 24 so as to hold covers 20** above the torso of the patient.

I claim:

1. In combination with a hospital bed of any width having a patient lying thereon, a bed cover lifter comprising:

six multisectional arms arranged in opposing spaced pairs between the head and foot of the bed and having vertically extending sections pivotally attached to the frame of the bed, each pair having a top side with curved sections and other sections interconnecting each opposed pair of curved sections, at least each of said vertical arms on the same side of the bed having a lower end beneath the pivot axis thereof;

means on some of said curved sections and said other interconnecting sections for frictionally slideably extending said top side to accommodate any bed width;

means for slidably interconnecting said vertical arms to said curved sections with thumb screw means for anchoring the so-adjusted parts;

an electric motor underneath said bed;

two identical gear pairs on each side of the bed, one gear of each gear pair being attached to the drive shaft of the motor, with the other gear of said gear pair fastened to each vertical arm of the pair of arms over the foot of the bed; and a horizontal arm temporarily attached by a pull ring and finger means to each of said lower ends of the vertical arms for enabling movement of the motor to rotate the gears and cause the vertical arms to keep the upper bedcovers supported by said bed cover lifter off the patient's body where desired.

2. The combination according to claim 1 wherein said horizontal arm and said interconnected lower end of said vertical arms include aligned passages and said pull ring and finger means includes a finger extending into said passages and a ball protrudes out of the finger urged by a spring for interfering with said passages, thus keeping the finger in the passage for anchoring the vertical arm.

* * * * *